US008867115B2

(12) United States Patent
Margerm et al.

(10) Patent No.: US 8,867,115 B2
(45) Date of Patent: Oct. 21, 2014

(54) CONTROL OF ARRAY OF TWO-DIMENSIONAL IMAGING ELEMENTS IN LIGHT MODULATING DISPLAYS

(75) Inventors: Steve Margerm, New Westminster (CA); Neil W. Messmer, Langley (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 13/384,864

(22) PCT Filed: Jul. 20, 2010

(86) PCT No.: PCT/US2010/042647

§ 371 (c)(1),
(2), (4) Date: Jan. 19, 2012

(87) PCT Pub. No.: WO2011/011446

PCT Pub. Date: Jan. 27, 2011

(65) Prior Publication Data

US 2012/0113498 A1 May 10, 2012

Related U.S. Application Data

(60) Provisional application No. 61/227,659, filed on Jul. 22, 2009.

(51) Int. Cl.
*G09G 3/34* (2006.01)
*G09G 3/36* (2006.01)

(52) U.S. Cl.
CPC ..... *G09G 3/3426* (2013.01); *G09G 3/3644* (2013.01); *G09G 2320/0646* (2013.01); *G09G 2310/04* (2013.01); *G09G 3/3666* (2013.01)
USPC ..... 359/238; 359/292; 359/298

(58) Field of Classification Search
USPC ..... 345/84–87; 348/739, 795, 800, 801; 359/290, 291, 298, 315–318
See application file for complete search history.

(56) References Cited

U.S. PATENT DOCUMENTS

| | | | |
|---|---|---|---|
| 5,576,731 | A | 11/1996 | Whitby |
| 6,816,142 | B2 | 11/2004 | Oda |
| 7,303,288 | B2 | 12/2007 | Miyazawa |
| 7,377,652 | B2 | 5/2008 | Whitehead |
| 7,419,267 | B2 | 9/2008 | Whitehead |
| 7,460,103 | B2 | 12/2008 | Konino |

(Continued)

FOREIGN PATENT DOCUMENTS

| | | |
|---|---|---|
| EP | 1640951 | 3/2006 |
| JP | 2000-275605 | 10/2000 |

(Continued)

*Primary Examiner* — Darryl J Collins
*Assistant Examiner* — Gary O'Neill

(57) ABSTRACT

Light emitting elements in an illumination unit of a display may be blanked during updates of pixels of a spatial light modulator (SLM). Updates of pixels in different segments of the SLM may be coordinated with blanking of corresponding segments of the illumination unit. Updating of segments of a light source (30A-30D) may be coordinated so that not all segments are updated in each frame (34A-37D) of a video.

24 Claims, 10 Drawing Sheets

(56) References Cited

U.S. PATENT DOCUMENTS

| | | | | |
|---|---|---|---|---|
| 7,581,837 | B2 | 9/2009 | Whitehead | |
| 8,035,604 | B2 | 10/2011 | Seetzen | |
| 2003/0174262 | A1 | 9/2003 | Sugawara | |
| 2005/0146773 | A1* | 7/2005 | Richards | 359/291 |
| 2005/0162737 | A1* | 7/2005 | Whitehead et al. | 359/454 |
| 2006/0139289 | A1 | 6/2006 | Yoshida | |
| 2006/0170617 | A1* | 8/2006 | Latypov et al. | 345/32 |
| 2007/0058087 | A1* | 3/2007 | Kettle et al. | 348/742 |
| 2007/0216311 | A1 | 9/2007 | Cernasov | |
| 2007/0247833 | A1 | 10/2007 | Lee | |
| 2008/0074060 | A1 | 3/2008 | Ye | |
| 2008/0111502 | A1 | 5/2008 | Kim | |

FOREIGN PATENT DOCUMENTS

| | | |
|---|---|---|
| JP | 2007-108484 | 4/2007 |
| JP | 2008-145966 | 6/2008 |
| JP | 2008-275892 | 11/2008 |
| TW | 0272562 | 2/2007 |
| WO | 03/077013 | 9/2003 |
| WO | 2006/010244 | 2/2006 |
| WO | 2006/010249 | 2/2006 |
| WO | 2006040737 | 4/2006 |
| WO | 2007138389 | 12/2007 |

* cited by examiner

40

CONTROL OF ARRAY OF TWO-DIMENSIONAL IMAGING ELEMENTS IN LIGHT MODULATING DISPLAYS

CROSS-REFERENCE TO RELATED APPLICATIONS

This application claims priority to U.S. Provisional Patent Application No. 61/227,659 filed Jul. 22, 2009 hereby incorporated by reference in its entirety.

TECHNICAL FIELD

The invention relates to control of light sources for light modulating displays. The invention has application, for example, to Liquid Crystal Displays (LCDs) and Liquid Crystal Projectors (LCPs).

BACKGROUND

Light modulating displays use arrays of light modulating elements to modulate light to produce visual images. Examples of such displays include displays as described in PCT Patent Publications PCT/CA03/00350 and PCT/CA2005/001111, and in United States patent applications US 2007/0268577 A1, US 2008/0043034 A1, US 2008/0043303 A1, US 2008/0111502 A1 and US 2008/0074060 A1, all of which are hereby incorporated herein by reference for all purposes.

Light modulating displays may be used to show video content. Because cathode ray tube (CRT) displays were the original video display technology, video content is typically provided to displays serially for raster scan display. In CRT raster scanning, an electron beam sweeps horizontally left-to-right across a screen at a steady rate, then turns off and moves rapidly back to the left, where it turns back on and sweeps out the next line. After the end of the last line of the image, the electron beam turns off and moves rapidly to the top-left to begin scanning the next image. Signals driving raster scanning displays typically include an image information signal, a horizontal synchronization signal and a vertical synchronization signal. The horizontal synchronization signal provides a pulse timed to coincide with the end of a horizontal line of element-specific image information. This pulse is used in CRT displays to control the turning off of the electron beam between horizontal lines. The vertical synchronization signal provides a pulse timed to coincide with the end of the last line of the image. This pulse is used in CRT displays to control the turning off of the electron beam between images.

Light modulating displays, such as LCD displays, typically accommodate video content provided serially for raster scan display by writing data for the next image to be displayed into a buffer. At some time after data for the next image to be displayed has been written into the buffer, the data in the buffer is latched into driving circuits for light modulating elements of a spatial light modulator (SLM), thereby replacing the existing data driving the light modulating elements with new data. The light modulating elements are then driven according to the new data.

As used herein in connection with light modulating elements and SLMs, the term "updating" includes driving a light modulating element according to new data. Some light modulating displays update the SLM in stages. At each stage image data is latched into the driving circuits of a plurality of light modulating elements.

Light modulating elements typically take some time to switch from one state to another. When the driving values of light modulating elements, such as pixels of LCD modulators, are changed, the light modulating elements may overshoot the desired output level and oscillate about the desired level before settling to the correct level. Such response characteristics can lead to an undesirable visual characteristic known as "inverse ghosting".

In displays known as dual modulation displays, both the SLM and a light source may be updated according to new image data. Some such dual modulation displays are known to be capable of delivering enhanced dynamic range and improved contrast. In dual modulation displays the SLM may be updated according to new image data before, after or at the same time as the light source is updated. The inventors have determined that timing of the updates according to new image data of the SLM and the light source can affect the visual characteristics of images, and produce perceived negative phenomena such as flicker and motion blur artifacts.

In some applications, dual modulation displays are used to display video. A display showing video typically receives image data representative of images (frames) that are to be displayed in sequence. It is frequently desirable to update both the SLM and the light source to display new frames. Updating both a SLM and a light source can be computationally intensive. Some displays lack the computational resources to update both the entire SLM and the entire light source at the video frame rate.

There is a need for methods and apparatus for controlling dual modulation displays in ways that reduce or avoid undesirable visual artifacts. Preferably, such apparatus and methods permit scaling or managing the computational burden associated with updating a light source. There is a specific need for such methods and apparatus for controlling light sources of liquid crystal displays.

SUMMARY

The invention has a variety of aspects. Aspects of the invention provide displays, controllers for displays and methods for controlling displays. The displays may comprise, for example, computer monitors, televisions, video monitors, commercial video displays, digital cinema displays, electronic billboards, specialized displays such as displays for medical imaging, virtual reality, vehicle simulators, or the like. The methods may be performed, for example, by display controllers.

Further aspects of the invention and features of embodiments of the invention are described below and illustrated in the accompanying drawings.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
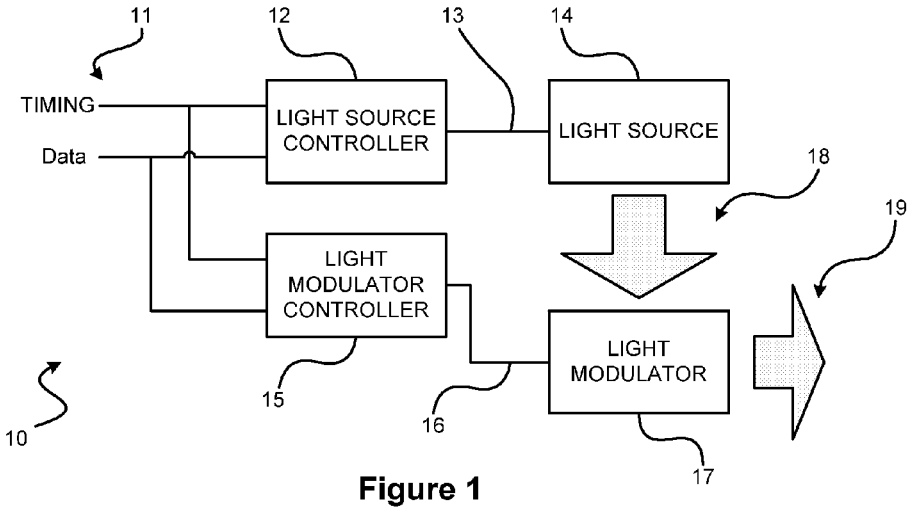
FIG. 1 is a schematic diagram of an LCD light modulating display system.

FIG. 1 shows a functional block diagram of a light modulating display system 10. Display system 10 comprises a light source controller 12 coupled to control a light source 14. Light source 14 may comprise, for example, an array of light emitters. In some embodiments, light source 14 comprises an LED backlight. Display system 10 also comprises a SLM controller 15 coupled to control a SLM 17. SLM 17 may comprise, for example, an LCD SLM. Input signals 11 are provided to light source controller 12 and SLM controller 15. Illumination controller 12 and light modulation controller 15 may comprise one or more processors, logic circuits, application specific integrated circuits (ASICs), field programmable gate arrays (FPGAs), programmable microcontrollers, general purpose computers, combinations thereof, or the like. Illumination controller 12 and SLM controller 15 may be integrated with one another in some embodiments.

In the illustrated embodiment, input signals 11 comprise a timing signal and a data signal. The timing signal comprises one or more signals that may be used by controller 12 as references for determining the timing for setting control information for light source 14. In embodiments, the timing signal may comprise one or more signals generated in response to activity affecting SLM 17, signals used to control the timing of events at SLM 17, signals related to or specifying the timing of data communicated by the data signal, combinations thereof, or the like. The timing signal may comprise, for example, a horizontal synchronization signal (hsync) and/or a vertical synchronization signal (vsync).

The data signal may comprise a plurality of signals, and may provide image and/or illumination control data. In some embodiments the data signal comprises video data in a format such as: HDMI, DVI, IEEE 1394, DisplayPort, VGA, S-Video, RGB analog component video, YPbPr analog component video, ATSC, DVB, ISBD, DMB, MUSE, NTSC, PAL, H.261, H.263, H.264/MPEG-4 AVC, M-JPEG, MPEG-1, MPEG-2, MPEG-4, Ogg-Theora, VC-1,/wiki/SMPTE Windows Media Video™ and Quicktime™. In some embodiments the data signal comprises data provided serially in a manner suitable for raster scan display. This is not mandatory however.

Light source controller 12 generates illumination control signals 13 based at least in part on input signals 11 to control light source 14. Light source 14 generates light 18 in response to illumination control signals 13. Light 18 illuminates SLM 17. SLM controller 15 generates SLM control signals 16 based at least in part on input signals 11 to control SLM 17. SLM 17 modulates light 18 according to SLM control signals 16.

Light 18 modulated by SLM 17 departs SLM 17 as output light 19. Output light 19 is perceptible as a visual image, for example, by the human eye. It will be appreciated that the image depicted by output light 19 is a product of both illumination control signals 13 generated by light source controller 12, by way of light source 14 and light 18, and of SLM control signals 16 generated by SLM controller 15, by way of SLM 17.

Suitable optical elements, such as, for example, diffusers, lenses, and collimators, may be provided in optical paths of system 10 in order to guide and/or manipulate light traveling the optical paths.

In some display systems 10 SLM control signals 16 are based in part on a light field simulation of the light provided to SLM 17 by light source 16. Such a light field simulation may be based at least in part on information indicative of the light provided to SLM 17 by light source 14, such as, for example, information contained in illumination control signals 13. Light field simulation is described, for example, in PCT publication No. WO 2006/010244 entitled RAPID IMAGE RENDERING ON DUAL-MODULATOR DISPLAYS which is hereby incorporated herein by reference for all purposes.

Figure 2:
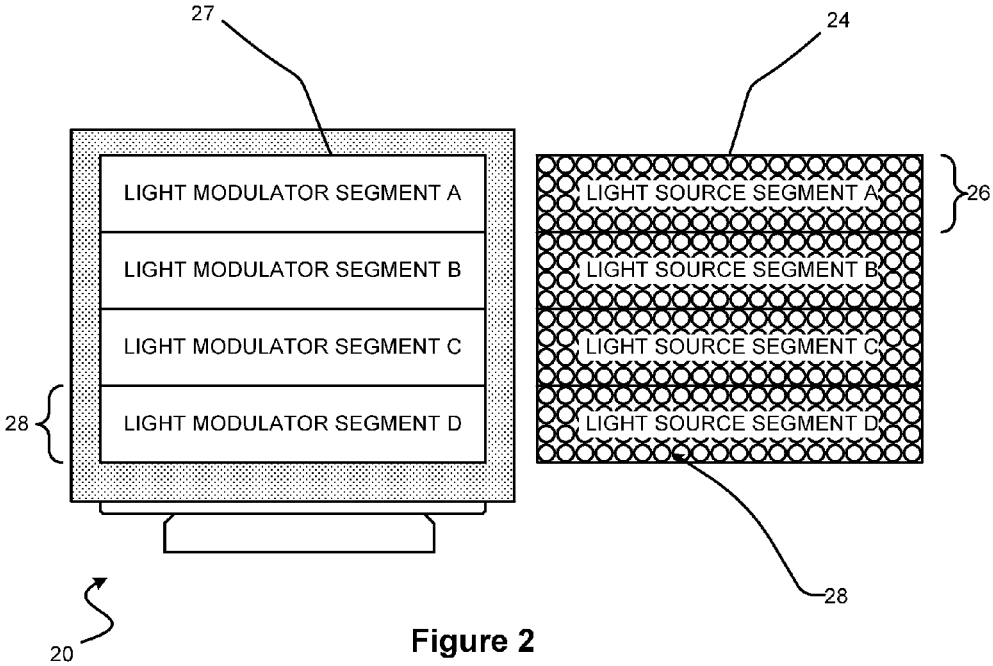
FIG. 2 is a block diagram of a light modulating display system according to an example embodiment.

FIG. 2 shows an example light modulating display system 20 according to another example embodiment. System 20 comprises a SLM 27 and a light source 24. SLM 27 may comprise an LCD SLM, for example. Light source 25 may comprise an LED backlight, for example. Light source 24 is shown beside SLM 27 for illustrative purposes. In embodiments, light source 24 is arranged so that light from light source 24 illuminates SLM 27. For example, light source 24 may be located directly behind SLM 27. In some embodiments light source 24 and SLM 27 comprises planar or curved structures mounted parallel to one another. Light from light source 24 may be broad spectrum light, for example, white light, though this is not mandatory. In some embodiments, light source 24 may comprise light emitters emitting different spectra of light.

SLM 27 comprises a plurality of light modulating elements (not shown in FIG. 2). In embodiments, light modulating elements may be individually controllable or controllable in groups. In some embodiments, the light modulating elements of SLM 27 comprise pixels of an LCD SLM.

Light source 24 comprises a plurality of light emitters 28. In embodiments, light emitters may individually controllable or controllable in groups. Light emitters 28 may comprise, for example, LEDs, electroluminescent panels (ELPs), cold cathode fluorescent lamps (CCFLs), woven fiber optic mesh panels, incandescent lamps, combinations thereof, or the like.

In some light modulating displays, light modulating elements of a SLM do not respond instantaneously to updates. Such light modulating elements may respond to updates with a transient behavior that can result in undesirable visual effects, such as, for example, inverse ghosting. The appearance of these visual effects may be suppressed, in whole or by degree, by reducing or eliminating the light provided to the affected spatial light modulating elements during the time that those light modulation elements might modulate light in a way that produces undesirable visual effects. Some embodiments reduce or eliminate the light provided to light modulation elements when they are updated by blanking (dimming or turning off) one or more light emitters that provide light to the affected light modulation elements. Where the light provided to light modulation elements is reduced or eliminated for a suitably brief interval, the momentary reduction or elimination of light may be unnoticed by a human observer. Apparatus embodying such methods may comprise an illumination controller configured to blank light emitters while light modulating elements that they illuminate are updated.

In some light modulating displays, perceived artifacts, such as flicker and motion blur artifacts, may result from the timing of updates to light modulation elements and light emitters. These artefacts may be minimized or eliminated by coordinating the timing of updates to light modulating elements with the timing of updates to light emitters that provide light to the light modulation elements. Some embodiments coordinate timing of updates to light modulation elements with timing of updates to light emitters taking into account the response characteristics of the SLM and/or the light source elements.

Some embodiments minimize these negative phenomena by updating light emitters at approximately the same time that the light modulation elements that they illuminate are updated. For example, embodiments may update light emitters soon before, while, or soon after the time that the light modulation elements that they illuminate are updated. In some embodiments, light emitters are updated immediately after being blanked. Apparatus embodying such methods may comprise an illumination controller configured to update light emitters while the light modulating elements that they illuminate are being updated, or soon thereafter.

In some embodiments light emitters are blanked and light modulation elements are updated at times controlled relative to a timing signal of an input signal 11.

Each of SLM 27 and light source 24 may comprise a plurality of segments. A segment is a set of elements that may be controlled together. In the case of SLM 27, a segment comprises light modulating elements. In the case of light source 24, a segment comprises light emitters.

For example, in some embodiments, elements belonging to a segment of SLM 27 or a segment of light source 24 can be updated together without updating elements belonging to other segments. In some embodiments, light source elements belonging to a segment of light source 24 can be blanked together without blanking light source elements belonging to other segments. In embodiments, actions such as, for example, updating and blanking, may be performed segment-by-segment. Segments may be hard wired (e.g. by providing a blanking circuit capable of blanking a group of light emitters) or defined in a configurable way (e.g. a group of elements to be updated together or blanked together may be defined in software).

In the illustrated system 20, the segments of light source 24 comprise light emitters 28 physically arranged in rectangular blocks. In some embodiments, each block comprises one or more complete rows of light emitters 28. Segment 26 is an example of such an arrangement. In the illustrated system 20, the segments of the light source 24 are shown as comprising adjacent rows of light emitters 28. However, it is not mandatory that the physical arrangement of elements in a segment be horizontal, linear or contiguous. In illustrated system 20, the group of light emitters 28 that correspond to a segment of light source 24 lie within a boundary that does not overlap with boundaries of any other segments of light source 24. In some embodiments some light emitters of one segment may be intermingled with light emitters of one or more other segments.

Actions on different segments may be done at different times. Actions may be performed on different segments in sequences not corresponding to the physical arrangement of the elements belonging to the segments. Actions on different segments may overlap in time, for example, an update of a second segment can start before the update of a first segment has finished. Actions on different segments may be done periodically, for example, every so many milliseconds. Actions on different segments may be done sequentially at fixed intervals, for example, some numbers of milliseconds apart. The ordering of actions on different segments may be changed dynamically. For example, in some embodiments, actions on segments normally done periodically may be deferred.

In some embodiments segments of SLM 27 are associated with corresponding segments of light source 24. The correspondence may be, but is not necessarily a 1:1 correspondence. Some embodiments coordinate actions performed on corresponding segments of SLM 27 and light source 24. For example, some embodiments blank segments of light source 24 while updating corresponding segments of SLM 27. Coordinating actions between segments of SLM 27 and segments of light source 24 may be facilitated by correspondence relationships between segments. In some embodiments, correspondence relationships exist between a segment of light source 24 and one or more segments of SLM 27 that can be illuminated by light from the segment of light source 24. Such relationships may be conveniently referred to as illumination correspondence relationships.

Correspondence relationships between segments of SLM 27 and segments of light source 24 may be one-to-one, one-to-many, many-to-one, or a combination thereof. A segment may have more than one correspondence relationship. For example, a light source segment may have a first correspondence relationship with a first and second SLM segments, and also have a second correspondence relationship with a third SLM segment.

In some displays configured to display video, it may not be possible or desirable to update all segments of a SLM or of a light source in the frame period defined by a frame rate of a video. This may be due to computational, heat or power constraints, for example. For example, it may not be possible or desirable to update all segments of light source 24 in a frame period defined by a frame rate of a video shown on display system 20. Where this is the case, a subset of the segments may be updated during a frame period. In some embodiments the number of segments updated in each frame period is constant. In other embodiments, the number of segments updated in each frame period varies, for example the segments may be prioritized for updating and as many frames updated in a each period as time allows.

Figure 3A:
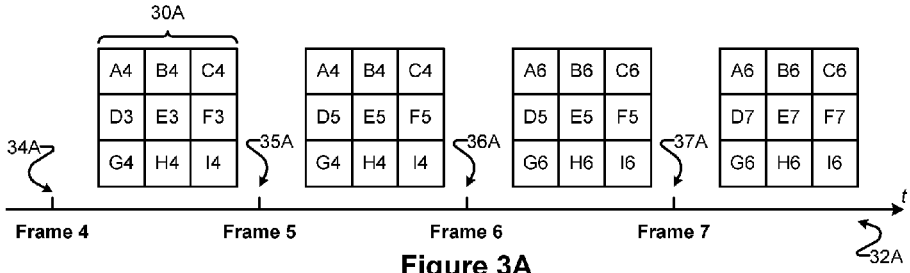
FIG. 3A is an illustration of a group of segments updated according to an example embodiment in response to a sequence of frames.

In some embodiments, the updates of segments may be done over a sequence of frames according to a fixed pattern. FIG. 3A shows a group 30A of nine segments updated according to an example embodiment over a sequence in time 32A of four frames 34A, 35A, 36A, 37A. Group 30A may comprise segments of a light source. Group 30A may comprise all or a subset of the segments of a SLM or of a light source. Each segment is identified by a letter (A, B, C, D, E, F, G, H, I). For every frame in the sequence, some of the segments may be updated. Each segment is labeled with a number that denotes the frame at which the segment was last updated. For example, at frame 34A, which is labeled Frame 4, segments identified as A, B, C, G, H and I are updated. Segments identified as A, B, C, G, H and I are updated at even-numbered frames (34A, 36A), and segments identified as D, E and F are updated at odd-numbered frames (35A, 37A). In the example embodiment illustrated in FIG. 3A, for any two consecutive frames, one sub-set of the segments of in group 30A is updated for the first consecutive frame, and the another sub-set of the segments in group 30A is updated for the second consecutive frame. Accordingly, two sub-sets of segments in group 30A are updated in an alternating fashion. In some embodiments, segments are updated every other frame, and in some such embodiments updates on sub-sets of segments may be done in an alternating fashion.

Figure 3B:
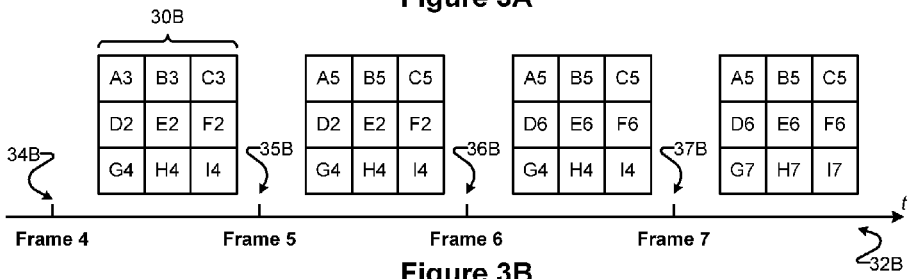
FIG. 3B is an illustration of a group of segments updated according to an example embodiment in response to a sequence of frames.

FIG. 3B shows a group 30B of nine segments updated according to an example embodiment over a sequence in time 32B of four frames 34B, 35B, 36B, 37B. Group 30B may comprise segments of a light source. Group 30B may comprise all or a subset of the segments of a light source. Each segment is identified by a letter (A, B, C, D, E, F, G, H, I). For every frame in the sequence, some of the segments are updated in response to the frame. Each segment is labeled with a number that denotes the frame at which the segment was last updated. For example, at frame 34B, which is labeled Frame 4, segments identified as G, H and I are updated. Segments identified as A, B, C are updated at frame 35B; segments identified as D, E and F are updated at frame 36B; and segments identified as G, H and I at frame 37B. In the example embodiment illustrated in FIG. 3B, for any three consecutive frames, a first sub-set of the segments of in group 30B is updated for the first consecutive frame, a second sub-set of the segments of group 30B is updated for the second consecutive frame, and a third sub-set of the segments in group 30B is updated for the third consecutive frame. Accordingly, three sub-sets of segments in group 30A are updated in a rotating fashion. In some embodiments, segments are updated every third frame in a rotating fashion.

In some embodiments light source segments are updated every third frame in a rotating fashion, such that all segments of an light source are updated at least once in every set of three consecutive frames. In other embodiments, segments are updated after other fixed numbers of frames. In some of such embodiments, updates may be done on sub-sets of segments in a rotating fashion. It will be appreciated that sub-sets of segments may comprise some, all or none of the segments of a light source or SLM. It will also be appreciated that a segment may belong to one or more sub-sets of segments for a particular light source or SLM.

Updating segments in alternating or rotating fashions are particular examples of the more general concept of updating segments based on update histories. Consider that where sub-sets of segments are updating in an alternating fashion, whether a particular segment is updated in a given frame depends on whether or not it was updated for the most recent past frame, i.e., on its update history.

In embodiments, updates of segments may be performed according to properties of an update, such as, for example differences between a next frame and one or more previous frames. In some embodiments, updates of segments may be done according to differences between a next frame (i.e., the frame after the most recent previous frame) and a last frame (i.e., the most recent previous frame). For example, segments corresponding to parts of a frame that differ more as between the next frame and the last frame may be updated in priority to segments corresponding to parts of a frame that differ less. In some embodiments, updates of segments may be done according to differences between a next frame and one or more previous frames in which the segments were last updated.

Figure 3C:
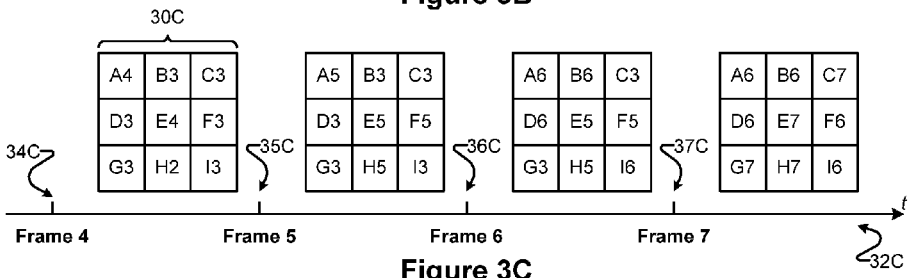
FIG. 3C is an illustration of a group of segments updated according to an example embodiment in response to a sequence of frames.

FIG. 3C shows a group 30C of nine segments updated according to an example embodiment over a sequence in time 32C of four frames 34C, 35C, 36C, 37C. Group 30C may comprise segments of a light source. Group 30C may comprise all or a subset of the segments of a light source. Each segment is identified by a letter (A, B, C, D, E, F, G, H, I). For every frame in the sequence, some of the segments are updated in response to the frame. Each segment is labeled with a number that denotes the frame at which the segment was last updated. For example, at frame 34C segments identified as A and E are updated in frame 34C. As between frame 34C and frame 35C, segments identified as A, E, F and H correspond to parts of an image that differ more than the parts of the image corresponding to segments identified as B, C, D, G and I. In frame 35C, segments identified as A, E, F and H are updated and segments identified as B, C, D, G and I are not. As between frame 35C and 36C, segments identified as A, B, D and I correspond to parts of an image that differ as more than the parts of the image corresponding to segments identified as C, E, F, G and H. In frame 36C, segments identified as A, B, D and I are updated, and segments identified as C, E, F, G, and H are not.

In some embodiments a fixed number of segments corresponding to most changed parts of an image as between a next and one or more previous frames are updated. In other embodiments the number of segments that are updated may differ from one frame to another. In embodiments, differences between a next frame and one or more previous frames may determine which segments are updated in response to the next frame and/or an order in which segments are updated in response to the next frame.

In embodiments, differences between frames may comprise differences between image element data, such as pixel data, for frames. Any suitable measure of difference may be applied. For example, difference between two pixel data may comprise a sum of the absolute differences between each of the components of the pixel data. For instance, pixel data may be specified as a set of three components for each pixel. The components may comprise, for example, components specifying a point in a color space, such as YUV, RGB, or the like. A difference between two such pixel data may be the sum of the three absolute differences of the pixels' components. In some embodiments, updating may be done according to difference in chrominance components, luminance components, or a combination of chrominance and luminance components. In some embodiments, updating may be done according to differences in luminance, intensity or brightness values for pixels corresponding to different segments.

In some embodiments that comprise both a SLM and a light source, where a part of an image does not change much from one frame to the next, SLM segment(s) corresponding to the part of the image are updated and the light source segment(s) corresponding to the part of the image are not updated. In some embodiments where the control of a SLM is based in part on a light field simulation of the light provided by an light source to the SLM, the light field simulation of the light provided by the light source segment(s) corresponding to the part of the image could be saved and re-used in the control of the SLM until the light source segment(s) are updated.

In some embodiments, updates of segments may be done according to a combination of the differences between the next frame and one or more previous frames, and the number of frames that have been displayed since segments were last updated (i.e., update histories of segments). For example, updates may be done such that all of the segments that have not been updated for the past two frames are updated in priority to other segments. Segments may be updated in order of differences between corresponding parts of a frame as between the next frame and the frame in which the segment was last updated.

In FIG. 3C, as between frames 36C and 37C, segments identified as A, E, H and I correspond to parts of an image that differ more than the parts of the image corresponding to segments identified as B, C, D, F, and G. However, at the time of frame 37C, the segments identified as C and G have not been updated in response to either of the two previous frames (frames 35C and 36C). In response to frame 37C, segments identified as C, E, G, and H are updated, and segments identified as A, B, D, F and I are not.

In some embodiments, the quantity of segments that are updated based on differences between frames is fixed, regardless of how many segments are updated based on the number of frames that have been displayed since segments were last updated. In other embodiments, the quantity of segments that are updated based on differences varies inversely with the quantity of segments that are updated based on the number of frames that have been displayed since they were last updated. In some such embodiments, the total quantity of segments that are updated per frame is fixed or limited.

In embodiments, updates of segments may be done according to a property of an update comprising a difference between segments' current states and segments' hypothetically updated states, i.e., the states that would result from an update in response to the next frame. For example, segments whose hypothetically updated states differ the most from their current states may be updated in priority to segments whose hypothetically updated states differ less from their current states.

Figure 3D:
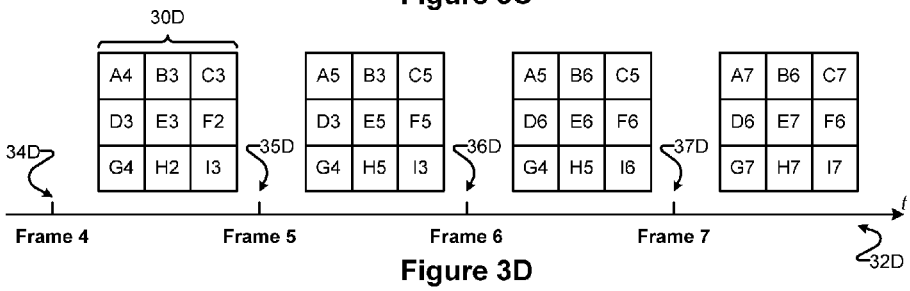
FIG. 3D is an illustration of a group of segments updated according to an example embodiment in response to a sequence of frames.

FIG. 3D shows a group 30D of nine segments updated according to an example embodiment over a sequence in time 32D of four frames 34D, 35D, 36D, 37D. Group 30D may comprise segments of a light source. Group 30D may comprise all or a subset of the segments of a light source. Each segment is identified by a letter (A, B, C, D, E, F, G, H, I). For every frame in the sequence, some of the segments are updated in response to the frame. Each segment is labeled with a number that denotes the frame at which the segment was last updated. For example, at frame 34D segments identified as A and G are updated in response to frame 34D. If all of the segments in group 30D were to be updated in response to frame 35D, the segments identified as A, C, E, F and H would differ more from their pre-update states than would the segments identified as B, D, G and I. In response to frame 35D, the five segments whose hypothetically updated states differ most from their current states are updated; accordingly, segments identified as A, C, E, F and H are updated and segments identified as B, D, G and I are not. If all of the segments in group 30D were to be updated in response to frame 36D, the segments identified as B, D, E, F and I differ more from their pre-update states than would the segments identified as A, C, G and H. In response to frame 36D, the five segments whose hypothetically updated states would differ most from their current states are updated; accordingly, segments identified as B, D, E, F and I are updated and segments identified as A, C, G and H are not.

In some embodiments a fixed number of segments whose hypothetically updated states differ most from their current states are updated. In other embodiments the number of segments whose hypothetically updated states differ most from their current states that are updated may differ from one frame to another. In embodiments that update segments according to this fashion, differences between the current segment states and hypothetically updated segment states may determine which segments are updated for a frame and/or an order in which segments are updated for a frame.

In embodiments, differences between one segment state and another segment state, or between a segment state and a hypothetical segment state, may comprise: differences between control information generated, or that would be generated, in response to different frames; differences in light emitter driving information generated, or that would be generated, in response to different frames; combinations thereof, or the like. In some embodiments, differences between one segment state and another segment state, or between a segment state and a hypothetical segment state may comprise differences inferred, estimated, or determined from differences between two or more frames, such as, for example, a next frame and one or more previous frames.

In some embodiments, updates of segments may be done according to a combination of the differences between segments' current states and hypothetically updated states, and the number of frames that have been displayed since segments were last updated (i.e., update histories of segments). For example, updates may be done such that all of the segments that have not been updated for a certain number of frames, for example the past two or three frames, are updated in priority to segments are updated in order of difference between segments' current states and the states that would result from an update in response to the next frame. If all of the segments in group 30D were to be updated according to frame 37D, the segments identified as B, D, E, F and I differ more from their pre-update states than would the segments identified as A, C, G and H. However, at the time of frame 37D, the segments identified as C and G have not been updated in response to either of the two previous frames (frames 35C and 36C). In response to frame 37C, segments identified as C, E, G, H and I are updated, and segments identified as A, B, D, and F are not.

In some embodiments, the number of segments updated based on the difference between their current state and hypothetically updated state is fixed, regardless of how many segments are updated based on the number of frames that have been displayed since segments were last updated. In other embodiments, the quantity of segments that are updated based on differences between current states and hypothetically updated states varies inversely with the quantity of segments that are updated based on the number of frames that have been displayed since they were last updated. In some such embodiments, the total quantity of segments that are updated per frame is fixed or limited.

Though in the example embodiments illustrated in FIGS. 3A, 3B, 3C and 3D segments are updated every frame, in other embodiments no segments are updated for some frames. For example, some embodiments do not update any segments where an image to be displayed does not change or does not change much from one frame to the next. For example, in some embodiments a backlight may be updated as described in US 2007/0285587, which is incorporated herein by reference for all purposes.

In some embodiments where segments are updated according to a pattern or algorithm, the pattern or algorithm may be interrupted or suspended to provide frames where no updates are performed. In some embodiments where segments are updated according to a pattern or algorithm, the pattern or algorithm may not be interrupted or suspended for frames though no updates are performed (i.e., the update dictated by pattern or algorithm is generated but not applied). In some embodiments where segments are updated according to a pattern or algorithm, where no segments are updated in a frame, the pattern or algorithm may be interrupted or suspended, or not interrupted or suspended, depending on circumstances.

Figure 4:
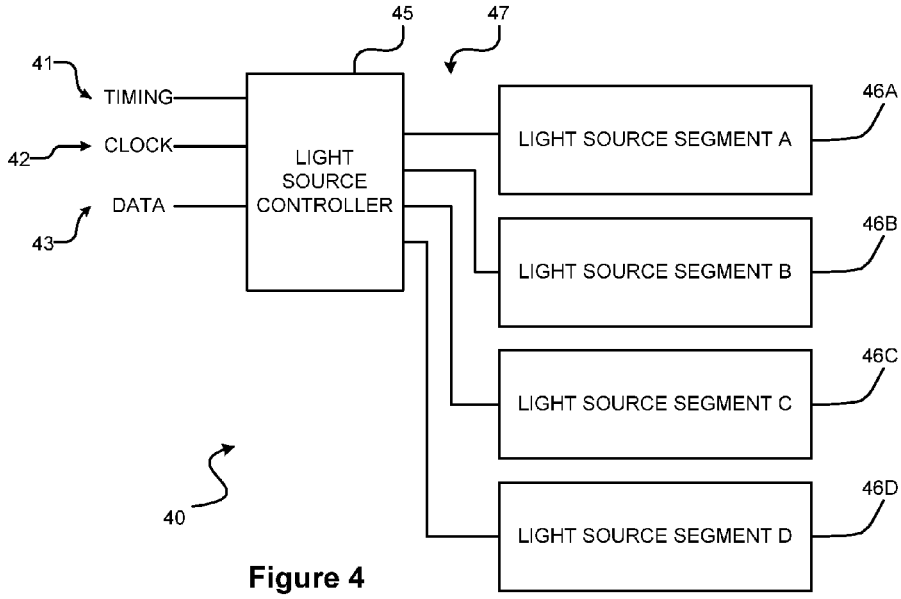
FIG. 4 is a block diagram of a light source controller according to an example embodiment.

FIG. 4 shows an illumination system 40 for a display according to an example embodiment, the system comprising an illumination controller 45 and light source segments 46A, 46B, 46C and 46D. Light source segments 46A, 46B, 46C and 46D comprise rows or other arrays of light emitters (not shown). Driving circuits (not shown) are configured to drive the light emitters in response to control signals from controller 45. Light source segments 46A, 46B, 46C and 46D may form an light source, such as, for example, an LED backlight. Light source controller 45 receives inputs comprising timing 41, clock 43 and data 44, and outputs control information 47.

Timing 41 comprises one or more signals used by controller 45 as a reference for generating control information for light source segments 46A, 46B, 46C and 46D. Timing 41 may comprise signals that indicate the timing of events at an associated SLM. For example, timing 41 comprises one or more signals that is generated in response to activity at a SLM, used to control a SLM, or related to the timing of image data received at a SLM. In some embodiments, timing 41 may comprise either or both of a vertical synchronization signal and a horizontal synchronization signal. Illumination controller 45 may use timing 41 as a reference for determining when to initiate actions at segments, such as updates and blanking.

Clock 43 comprises a timing source for the data signal. In some embodiments, the data 43 comprises illumination control data (i.e., data specifying control of light emitters).

Data comprises one of more signals that may be used by controller 45 as a basis for generating control information for light source segments 46A, 46B, 46C and 46D. In some embodiments, data 43 comprises image data and controller 45 generates illumination control data from the image data, according to a mapping of the image data to light emitters. For example, for a particular image data subset corresponding to a spatial image region, controller 45 may generate appropriate illumination control data for the light emitter or elements corresponding to the spatial image region. In other embodiments, data comprises illumination control data indicative of the illumination that should be provided by light emitters of light source segments 46A, 46B, 46C and 46D.

Light source controller 45 outputs illumination control signals for light source segments 46A, 46B, 46C and 46D based on at least the inputs timing 41 and data 44.

Figure 5:
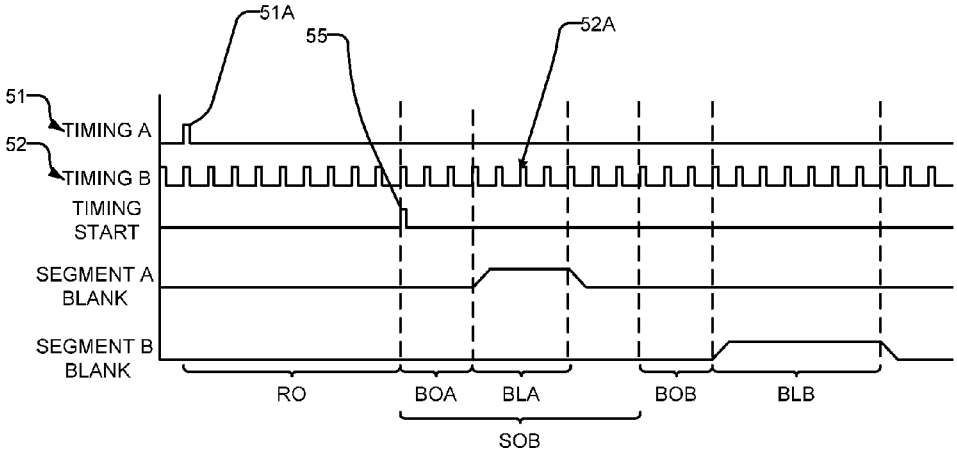
FIG. 5 is a timing diagram of events at a light source controller according to an example embodiment.

FIG. 5 shows a timing diagram 50 showing a possible timing for events at an illumination system such as illumination system 40 of FIG. 4. Timing 41 of FIG. 4 comprises timing_A 51 and timing_B 52 of timing diagram 50. Timing_A 51 may comprise a vertical synchronization signal, for example. Timing_B 52 may comprise a horizontal synchronization signal, for example.

After a refresh offset RO from timing_A indication 51A, controller 45 generates a timing start indication 55. After segment A blank offset BOA from timing start indication 55, controller 45 causes light source segment 46A to be blanked for duration BLA. In embodiments, controller 45 causes light source segment 46A to be blanked by, for example, outputting control information to light source segment 46A. that causes the light emitters of light source segment 46A to be blanked.

During the time that light source segment 46A is blanked, the light modulating elements of a corresponding segment of an associated SLM (not shown in FIG. 4) may be updated.

After segment B offset SOB and segment B blank offset BOB from timing start indication 55, controller 45 causes light source segment 46B to be blanked for duration BLB. During the time that light source segment 46B is blanked, the light modulating elements of a corresponding segment of an associated SLM (not shown in FIG. 4) may be updated.

In the example embodiment illustrated in FIG. 5, timing_A 51 and timing_B 52 provide binary indications. It will be appreciated that indications in embodiments may comprise any of a wide variety of forms. For example, in embodiments an indication could comprise a change to a value stored in a register (e.g., a register monitored by an illumination controller). In embodiments where such a register is configured to take on many values, the register could indicate multiple aspects of the timing of an associated SLM. For example, a register could be configured to indicate an update to a segment or set of segments of an associated SLM by changing to a value representative of that segment or group of segments during the time that the segment or group of segments is being updated. In some embodiments, indications could be provided as signals on wires or on a bus.

In the example embodiment illustrated in FIG. 5, blank offset BLB is relative to segment offset SOA, which is relative to timing start indication 55. In embodiments, blank offsets may be relative to a timing start indication or relative to a timing input, for example, an indication of the timing of events at an associated SLM.

In the example embodiment illustrated in FIG. 5, segment offsets, blank offsets and blank lengths correspond to integer numbers of timing_B indications 52A. In other embodiments, segment offsets, blank offsets and/or blank lengths may be specified in terms of clock pulses or edges, and such embodiments may thereby obtain more precise or different timing. In some embodiments, segment offsets, blank offsets and/or blank lengths are specified in time units that are independent of the timing of the associated SLM or data supplied thereto, such that the resolution of segment offsets, blank offsets and/or blank lengths are independent of the timing of the associated SLM or data supplied thereto.

Segment offsets, blank offsets and blank lengths are arbitrary with respect to timing indications (e.g., vertical and horizontal sync pulses). Embodiments may therefore provide arbitrary control of blanking of light source segments with respect to SLM updates. For example, during a single image update an light source segment may be blanked and unblanked multiple times, individually or in tandem with other segments. In some embodiments, blanking pulses have a duty cycle of more than 50 percent, such that light source segments are normally off.

Figure 6A:
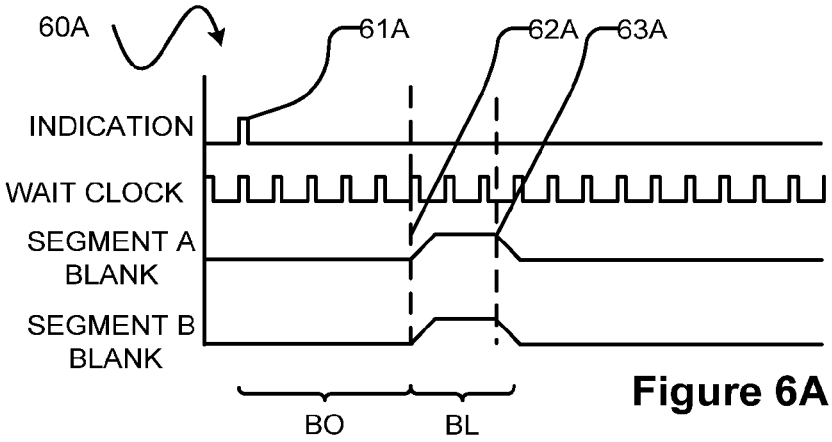
FIG. 6A is a timing diagram of blanking according to an example embodiment.

In FIG. 6A, timing diagram 60A shows a timing of blanking and un-blanking in tandem at an example embodiment. Segment A and segment B are simultaneously blanked 62A after blank offset BO from timing indication 61A. Segments A and B are blanked for a duration of blank length BL until un-blanked 63A.

Figure 6B:
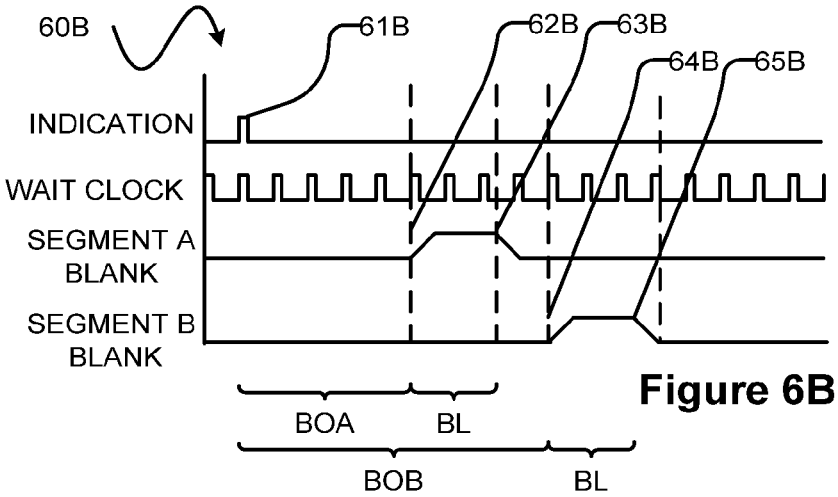
FIG. 6B is a timing diagram of blanking according to an example embodiment.

In some embodiments, segments are blanked in a rolling fashion such that segments are blanked and un-blanked in sequence, one segment at a time. In FIG. 6B, timing diagram 60B shows a timing of blanking in a rolling fashion according to another example embodiment. Segment A is blanked 62B after blank offset BOA from timing indication 61B. Segment A is blanked 62B for a duration of blank length BL until un-blanked 63B. Segment B is blanked 64B after blank offset BOB from timing indication 61B. BOB is longer than BOA and BL combined, so that segment B is blanked 64B after segment A is unblanked 63B. Segment B is blanked 64B for a duration of blank length BL until un-blanked 65B.

Figure 6C:
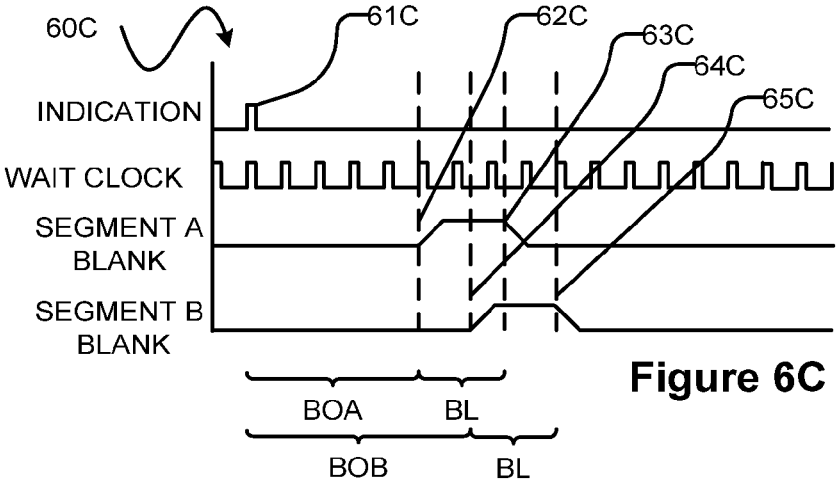
FIG. 6C is a timing diagram of blanking according to an example embodiment.

In some embodiments, segments are blanked in a cascading fashion such that segments are blanked in sequence, and are not unblanked until after segments later in the sequence are blanked. In FIG. 6C, timing diagram 60C shows a timing of blanking in a cascading fashion according to another example embodiment. Segment A is blanked 62C after blank offset BOA from timing indication 61C. Segment A is blanked 62C for a duration of blank length BL until un-blanked 63C. Segment B is blanked 64C after blank offset BOB from timing indication 61C. BOB is longer than BOA, but shorter than BOA and BL combined, so that segment B is blanked 64C after segment A is blanked 62C but before segment A is un-blanked 63C. Segment B is blanked 64C for a duration of blank length BL until un-blanked 65C.

Blanking control may take into account properties of an associated SLM and properties of elements of an light source. For example, a blank offset may be such that the segment of the light source to which the blank offset pertains is blanked before the corresponding segment of the associated SLM is updated. In some embodiments, the blank length is such that while the segment of the light source is blanked there is sufficient time to update a corresponding segment of the associated SLM and drive the light modulation elements of that segment to settled output levels. In some embodiments, the duration that segments of the light source are blanked is minimized by blanking light source segments immediately before updates of the corresponding segments of the associated SLM begin and un-blanking light source segments immediately after the light modulation elements of that segment have settled output levels.

Segment offsets, blank offsets and blank lengths may be static or dynamic. For example, blank offset and blank lengths may be adjusted according to one or more properties of an update of an associated SLM, i.e., changes to the associated SLM in response to a new frame. For instance, blank length may be adjusted to be longer than the time that pixels of an LCD SLM are expected to take to settle to a new state after being updated. In some embodiments, an expectation of the time that an pixel will take to settle to a new state may be determined from a difference between the previous state and the new state, the new state, the number of pixels being updated at the same time, the operating temperature of one or more light emitters, the operating temperature the SLM, the ambient temperature, a combination thereof, or the like. In some embodiments, blank lengths may be determined after blanking has started. For instance, determining blank length may comprise monitoring the current in or voltage of one or more updated pixels, so as to obtain an indication of whether the one or more pixels has settled to its new state or an indication of the rate at which the one or more pixels is settling to its new state.

Values indicative of segment offsets, blank offsets and blank lengths may be stored in registers or memory, such as RAM, and accessed by way of a look-up table. For example, controller 45 may maintain a counter that tracks which segment of an associated SLM is currently being updated. Segment offset, blank offset and blank length values for the corresponding segment of the light source may be extracted from a look up table using the counter value as a key. In other embodiments, a key to a lookup table for a segment offset, blank offset or blank length may comprise information indicative of one or more properties of updates to a SLM, an light source or both. For example, the a key may comprise information indicative of an expectation of the time that light modulation elements will take to settle to a new state, such that keys comprising information indicative of an expectation of longer settling times correspond to longer blank lengths than keys comprising information indicative of an expectation of shorter settling times.

Figure 7:
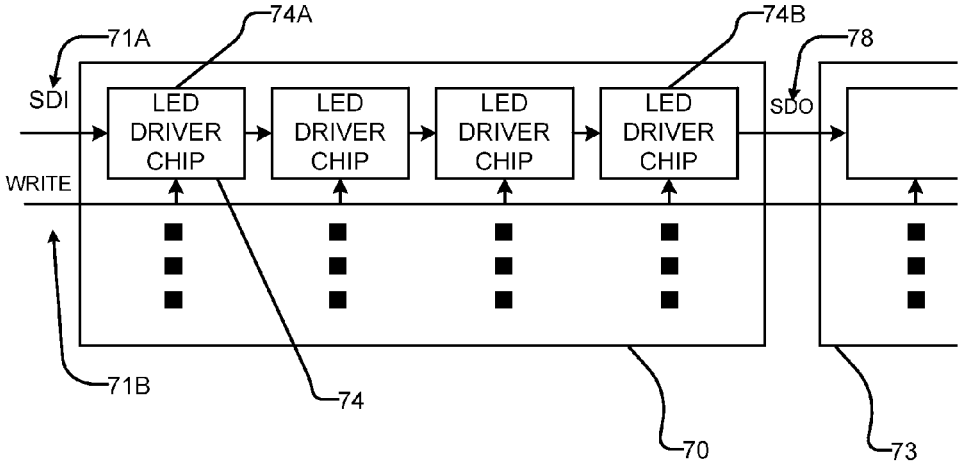
FIG. 7 is a block diagram of an LED driver board.

FIG. 7 shows an LED backlight board 70 according to an example embodiment. Board 70 comprises a plurality of LED driver chips 74. Board 70 receives illumination control data 71A at first driver chip 74A. Board 70 may receive illumination control data 71A from an illumination controller or another board. A plurality of driver chips on board 70 receive write signal 71B. Board 70 may receive write signal 71B from an illumination controller. Input illumination control data 61A is shifted into, buffered, and shifted out of driver chips 74, from one chip to a next chip, in a serial fashion. Board 70 is connected to a next board 73, and illumination control data shifted out of last driver chip 74B of board 70 is shifted into the first driver chip of board 73. Write signal 71B causes LED driver chips 74 to latch illumination control data buffered in each of the chips into registers on each of the chips.

In FIG. 7, the possible existence of other driver chips and relevant data and signal connections are indicated by vertical ellipsis. In the example embodiment illustrated in FIG. 7, write signal 71B is connected to LED driver chips on a plurality of boards. In other embodiments, a board may have a dedicated write signal or several dedicated write signals or may share several write signals with other boards.

In the example embodiment illustrated in FIG. 7, the LED driver chips 74 comprise LEDs (not shown), which are light emitters. Boards, such as boards like board 70, may comprise light emitters of more than one light source segment, and light source segments may comprise light emitters on a plurality of boards like board 70.

Figure 8:
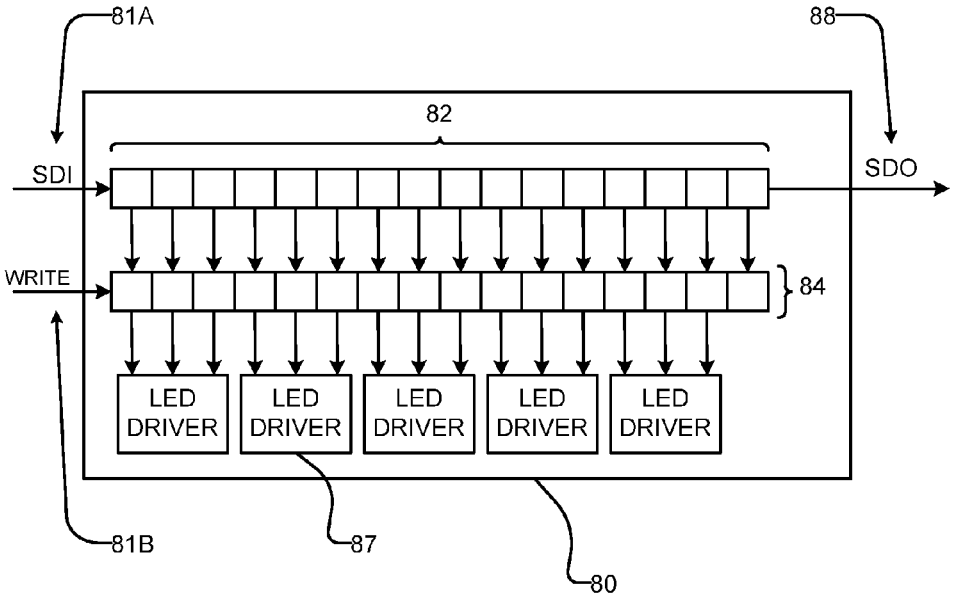
FIG. 8 is a block diagram of an LED driver chip.

FIG. 8 shows an LED driver chip 80 according to another example embodiment. LED driver chip 80 comprises first-in-first-out input buffer 82, output register 84 and LED drivers 87. LED driver chip 80 receives illumination control data 81A serially; such data may be received from another LED driver chip or an light source controller. LED driver chip 80 also receives write signal 81B. Received illumination control data is shifted through first-in-first-out input buffer 82. On reaching the end of buffer 82, illumination control data departs chip 80 as serial data out 88. Serial data out 88 may be communicated to other LED driver chips. Write signal 81B causes output register 84 to latch illumination control data from buffer 82. LED drivers 87 drive LEDs (not shown in FIG. 8) according to illumination control data in output register 84. In the example embodiment illustrated in FIG. 8, input buffer 82 and output register 84 comprise 16 bytes of data, and each three bytes of the first 15 bytes of output register 84 is provided to an LED driver 87. Each LED driver 87 drives a corresponding LED (not shown in FIG. 8) according to the three bytes of data that it is provided by output register 84. The last byte of data in output register 84 is not supplied to an LED driver. It will appreciated that embodiments may use any suitable configuration of buffers, registers and LED drivers.

In the example embodiment illustrated in FIG. 8, write signal 81B causes all of the illumination control data in buffer 82 to be latched into register 84. In other embodiments, a plurality of write signals may be supplied to chip 80 and output register 84 in order to provide finer control of latching of illumination control data from input buffer 82 into output register 84. For example, multiple write signals may be provided to output register 84 such that different write signals cause output register 84 to latch different bytes of data from input buffer 82. Since data in output register 84 affects the illumination provided by LEDs, which are light emitters, each write signal may define an light source segment.

In the example embodiment illustrated in FIG. 8, blanking may comprise filling input buffer 82 with illumination control data indicative of low or no illumination and then latching this data into output register 84. In other embodiments, blanking may comprise causing an output register to output data indicative of low or no illumination, for example, by tying the outputs of the output register to ground. Blanking may also comprise controlling LED drivers to drive the LEDs to provide low or no illumination, for example by tying the outputs of LED drivers to ground or by shutting down drive buffers. Some embodiments provide signals to LED driver chips that control output registers to output data indicate of low or no illumination. Some embodiments provide signals to LED driver chips that control LED drivers to drive the LEDs to provide low or no illumination.

Figure 9:
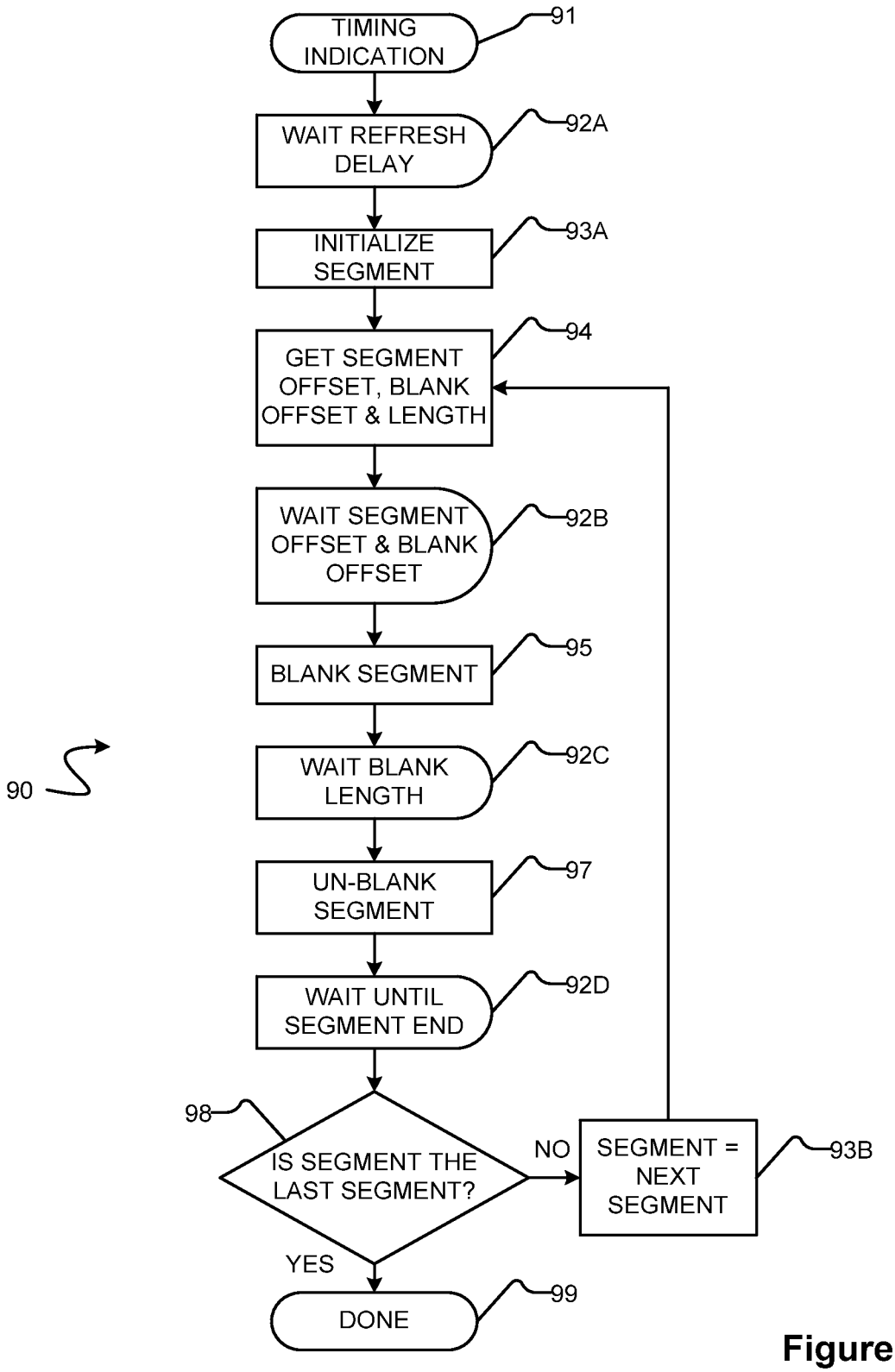
FIG. 9 is a flow chart of a method according to an example embodiment.

FIG. 9 shows a flow chart illustrating a method 90 for controlling an light source for an image update according to an example embodiment. Timing indication 91 initiates a wait for a refresh offset step 92A, which is followed by a step in which the current segment value is initialized 93A. Segment offset, blank offset and blank length values are then obtained for the current segment 94. A wait for the segment offset and blank offset step 92B follows. After the segment offset and blank offset expire, the current segment is blanked in step 95. After a step of waiting for the blank length 92C, the segment is un-blanked in step 97. A wait until the end of the current segment step 92D follows. Step 98 tests whether the current segment is the last segment of the light source that must be updated for the current image. The result of this test determines whether the illumination control process is repeated for a next segment 93B, or whether control of the light source is complete for the current image 99.

In some methods according to the embodiment illustrated in FIG. 9, the waiting steps may comprise incrementing, or alternatively decrementing, a counter, for example, incrementing a counter according to activity of one or more SLM timing indications, clocks, a combination thereof, or the like.

Obtaining blank offset and blank length values may comprise looking-up these values from a memory using a value indicative of the current segment as a key, reading values from a register, using hard-coded values, or the like, for example. The step of blanking the segment may comprise activating a blanking signal, or may comprise loading and latching blanking driving data into light emitters (e.g., driving data specifying little or no illumination). Un-blanking the segment may comprise de-activating a blanking signal, loading and latching illumination driving data into light emitters (e.g., driving data specifying illumination appropriate for the current image), or the like. The step of continuing the process for a next segment may comprise incrementing a counter, looking up information indicative of the next segment in a register or lookup table, processing a segment that is hard-coded or hard-wired as being a next segment, or the like, for example.

Figure 10:
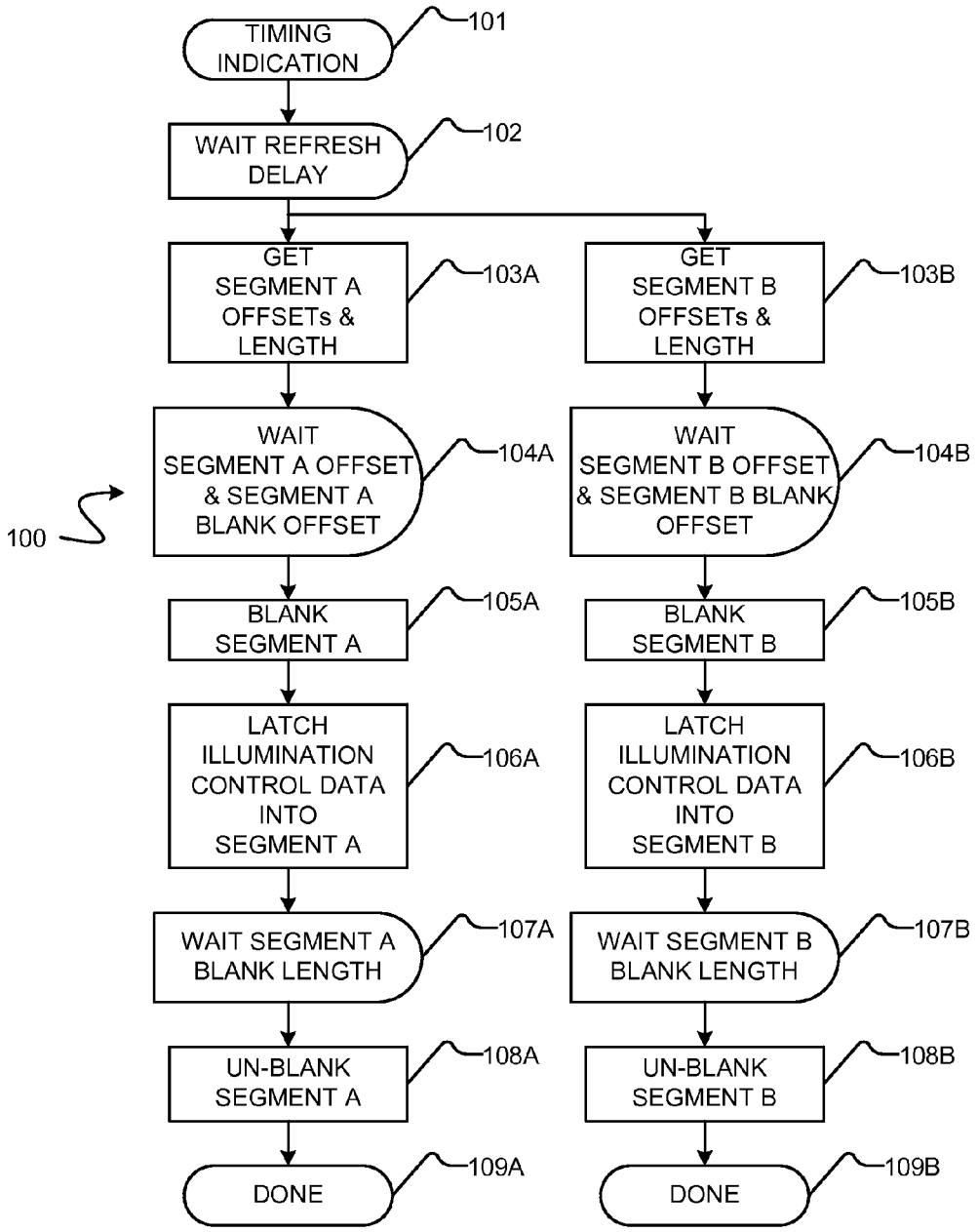
FIG. 10 is a flow chart of a method according to an example embodiment.

FIG. 10 is a flow chart illustrating a method 100 for controlling an light source for an image update according to an example embodiment. It will be appreciated that other embodiments are suitable for controlling greater numbers of segments of an light source. Timing indication 101 initiates a wait for a refresh offset step 102. Next, segment offset, blank offset and blank length values are obtained for segments A and B, respectively in steps 103A and 103B. Thereafter the control of segment A and segment B may proceed independently. Step 104A is a wait for segment A offset and segment A blank offset. After the segment A offset and segment A blank offset expire, segment A is blanked in step 105A and illumination control data is latched into segment A in step 106A. After a step 107A of waiting for the segment A blank length, segment A is un-blanked in step 108A and control of segment A is complete 109A until a next timing indication.

Similarly, step 104B is a wait for segment B offset and segment B blank offset. After the segment B offset and segment B blank offset expire, segment B is blanked in step 105B and illumination control data is latched into segment B in step 106B. After a step 107B of waiting for the segment B blank length, segment B is un-blanked in step 108B and blanking of segment A is complete 109B until the next timing indication.

The step of latching illumination control data into a segment may comprise latching illumination control data into all or some registers providing driving data to driving circuits of the light emitters comprised within the light source segment.

Figure 11:
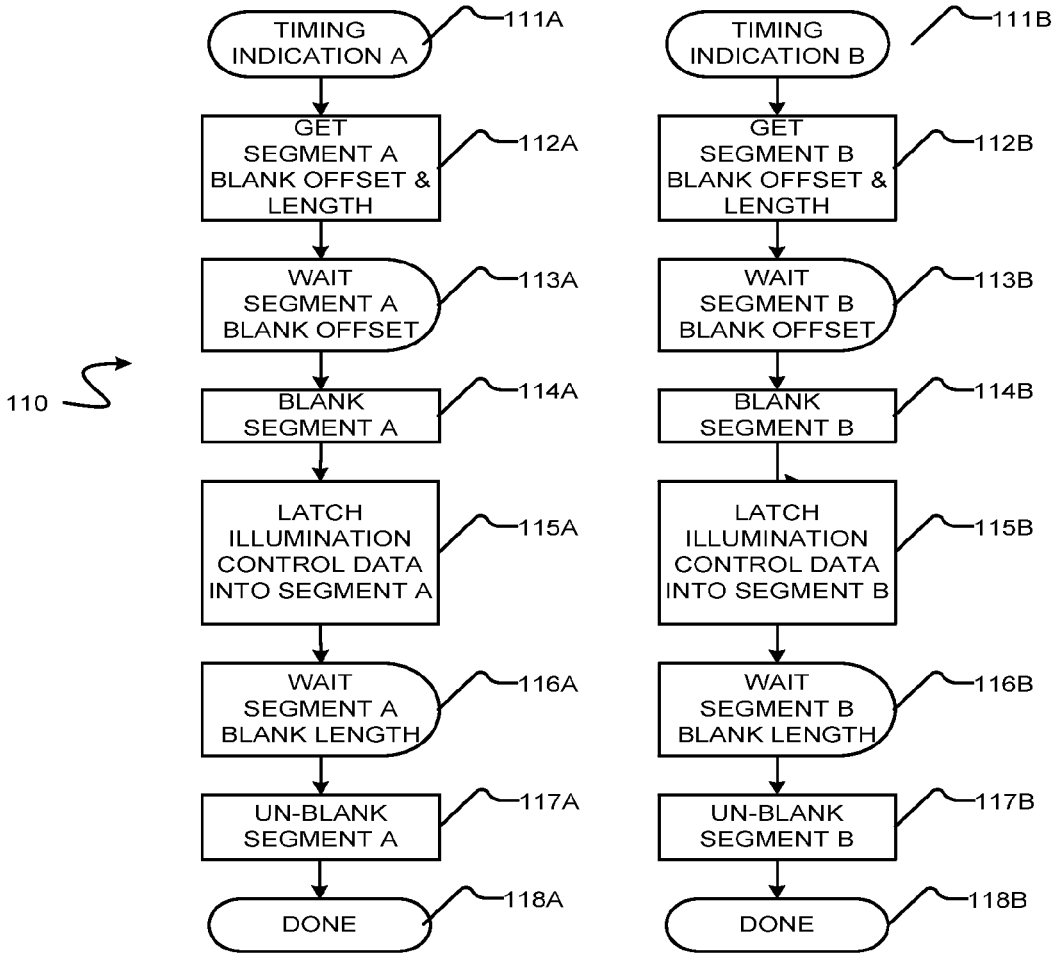
FIG. 11 is a flow chart of a method according to an example embodiment.

FIG. 11 is a flow chart illustrating a method 110 for controlling an light source for an image update according to an example embodiment. Other embodiments may control greater numbers of segments of an light source. In the illustrated embodiment, control of segments A and B is independent, and initiated by distinct timing indications. Timing indication A 111A causes segment offset, blank offset and blank length values to be obtained for segment A in step 112A. Next, step 113A is a wait for a segment A blank offset. After the segment A blank offset expires, segment A is blanked in step 114A and illumination control data is latched into segment A in step 115A. After a step 116A of waiting for the segment A blank length, segment A is un-blanked in step 117A and control of segment A is complete 118A until a next timing indication A.

Similarly, timing indication B 111B causes segment offset, blank offset and blank length values to be obtained for segment B in step 112B. Step 113B is a wait for segment B blank offset. After the segment B blank offset expires, segment B is blanked in step 114B and illumination control data is latched into segment B in step 115B. After a step 116B of waiting for the segment B blank length, segment B is un-blanked in step 117B and control of segment B is complete 118B until a next timing indication B.

Figure 12:
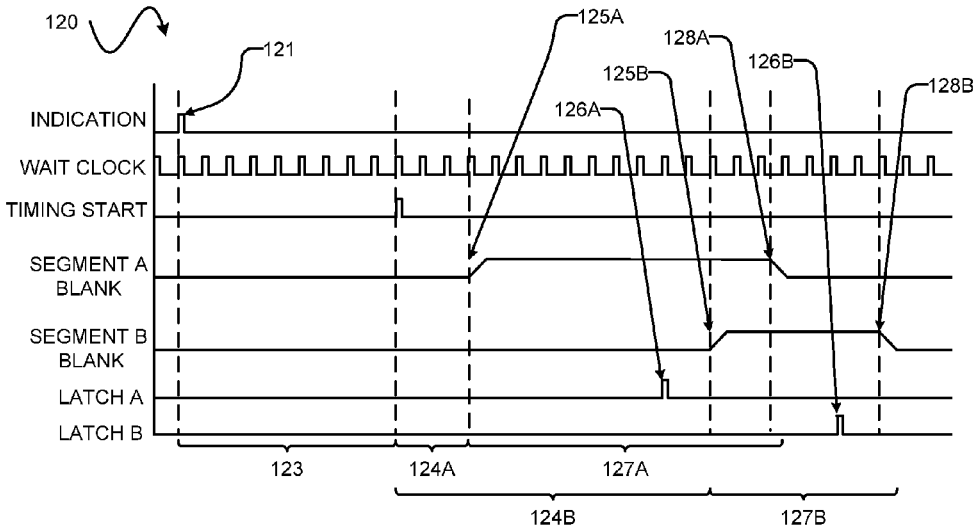
FIG. 12 is a timing diagram of a method according to an example embodiment.

FIG. 12 shows a timing diagram 120 of occurrences during a method according to the invention, such as the example embodiment illustrated in FIG. 8. Timing indication 121 marks the beginning of a wait for a refresh offset 122. Segment A blank offset 124A and segment B blank offset 124B begin at the end of refresh offset 123. At the end of segment A blank offset 124A, segment A is blanked 125A for a duration of segment A blank length 127A until un-blanking 128A. While segment A is blanked, illumination control data is latched 126A into segment A. At the end of segment B blank offset 124B, segment B is blanked 125B for a duration of segment B blank length 127B until un-blanking 128B. While segment B is blanked, illumination control data is latched 126B into segment B.

Figure 13:
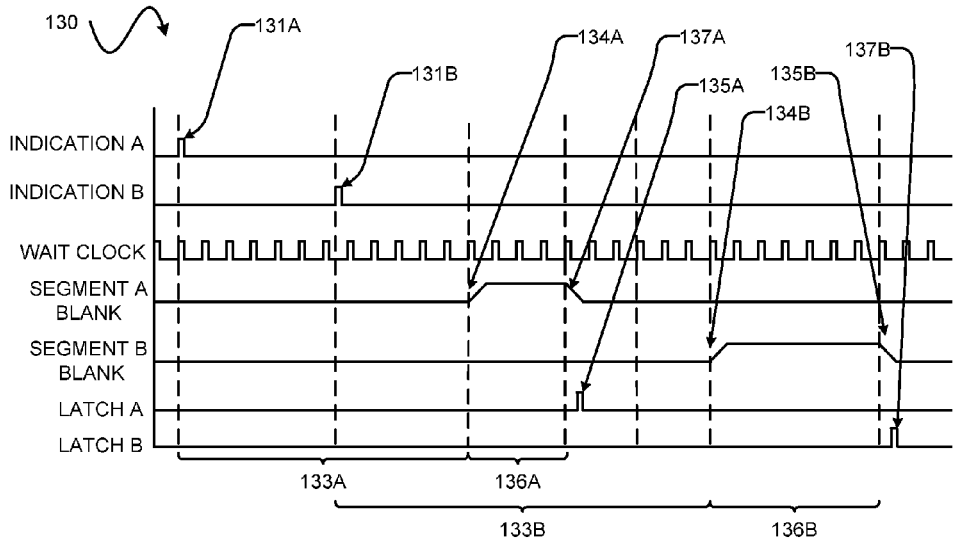
FIG. 13 is a timing diagram of a method according to an example embodiment.

FIG. 13 shows a timing diagram 130 of occurrences during a method according to the invention, such as the example embodiments illustrated in FIGS. 7 and 8. Timing indication A 131A marks the beginning of segment A blank offset 133A. At the end of segment A blank offset 133A, segment A is blanked 134A for a duration of segment A blank length 136A until un-blanking 137A. Immediately after segment A is un-blanked, illumination control data is latched 135A into segment A. Timing indication B 131B marks the beginning of segment B blank offset 133B. At the end of segment B blank offset 133B, segment B is blanked 134B for a duration of segment B blank length 136B until un-blanking 137B. Immediately after segment B is un-blanked, illumination control data is latched 135B into segment B. In other embodiments, segments may be updated at the same time as one another, for example, by synchronous blanking and latching of data into different segments. In some embodiments, updates of different segments overlap, for example, by cascading and overlapping blanking and cascading latching of data into different segments.

In another example embodiment segments of an light source and corresponding segments of a SLM are updated in a coordinated fashion that takes into account a time required for updates of the SLM to take effect. In this example embodiment, update of a segment of the light source is delayed by a time delay relative to the update of the corresponding segment of the SLM.

In some embodiments, a data value is provided in a register and the time delay has a length determined by the data value. In some embodiments, the segment of the light source is blanked during all or a portion of the time delay. A common signal (e.g. a common clock signal) may be provided to trigger both update of the SLM and initiation of the time delay. In some embodiments the time delay is controlled by a timer incorporated in a logic circuit that generates driving signals for elements of an light source. The logic circuit may, for example, br provided in an ASIC or as a configurable logic circuit such as a configured FPGA.

Figure 14:
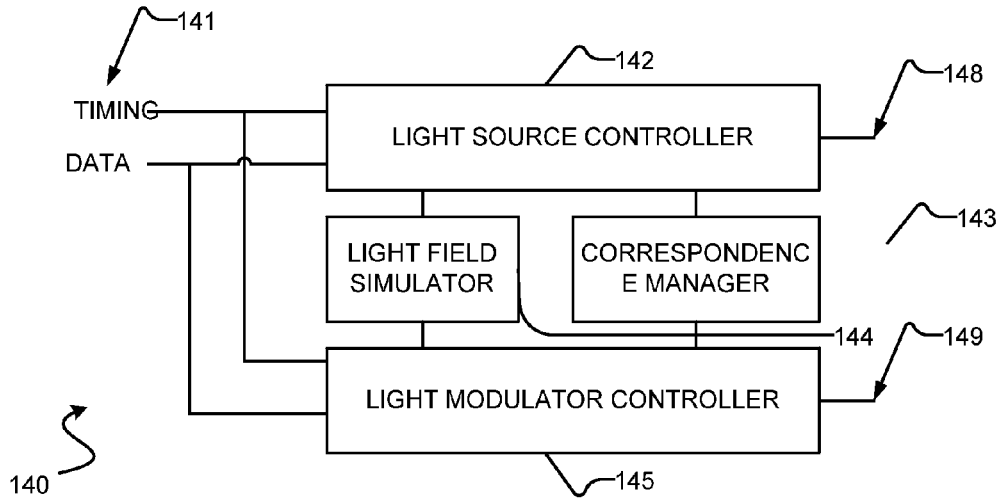
FIG. 14 is a block diagram of an apparatus according to an example embodiment.

FIG. 14 shows a block diagram of an apparatus according to an example embodiment. Controller 140 receives input signals 141. Input signals 141 may comprise, for example, a timing signal and a data signal. Light source controller 142 generates illumination control signals 148 based at least in part on input signals 141. Light field simulator 144 generates a light field simulation of the light provided to a SLM (not shown) that is controlled by light modulation control signals 149 by a light source (not shown) that is controlled by illumination control signals 148. Light modulation controller 145 generates light modulation control signals 149 based at least in part on input signals 141 and light field simulation data provided by light field simulator 144. Correspondence manager 143 maintains a configurable record of correspondence relationships between segments of the SLM (not shown) that is controlled by light modulation control signals 149 and segments of the light source (not shown) that is controlled by illumination control signals 148. Correspondence manager 143 provide correspondence relationship information to light source controller 142. Correspondence manager communicates light modulation control information from light modulator controller 145 to light source controller 142. Light source controller 142 generates illumination control signals 148 based at least in part on correspondence relationship information and light modulation control information provided by correspondence manager 153.

Figure 15:
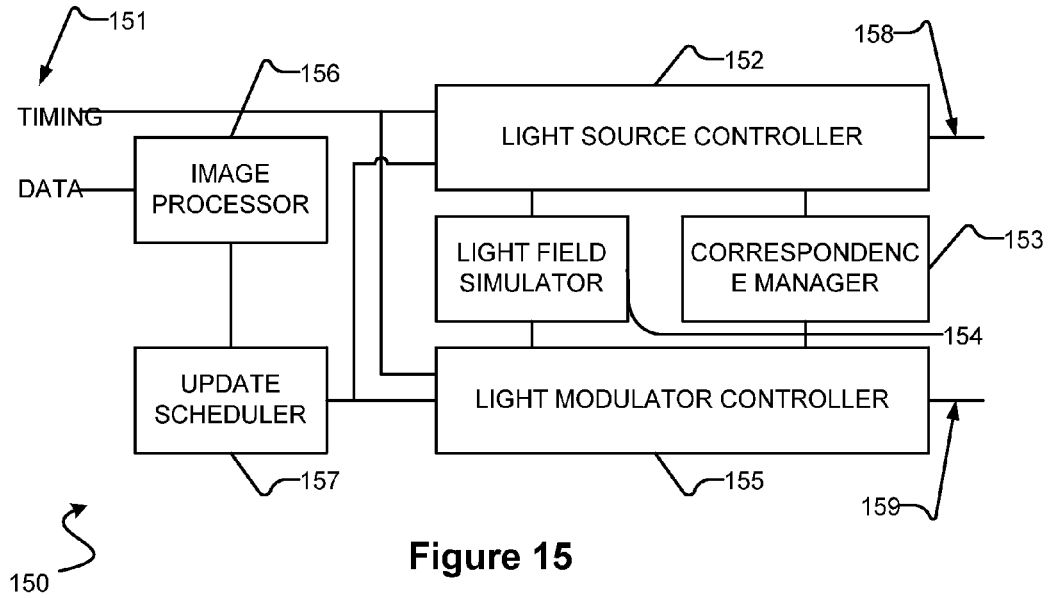
FIG. 15 is a block diagram of an apparatus according to an example embodiment.

FIG. 15 shows a block diagram of an apparatus according to an example embodiment. Controller 150 receives input signals 151. Input signals 151 may comprise, for example, a timing signal and an image data signal. Image processor 156 processes image data.

In embodiments, image processor 156 may determine differences between images of different frames, for instance, consecutive frames. In embodiments, differences images may comprise differences between image element data, such as pixel data, for frames. Image processor 156 may determine a variety of suitable measures of difference. For example, a difference between two pixel data may comprise a sum of the absolute differences between each of the components of the pixel data. For instance, pixel data may be specified as a set of three components for each pixel. The components may comprise, for example, components specifying a point in a color space, such as YUV, RGB, or the like. A difference between two such pixel data may be the sum of the three absolute differences of the pixels' components. In some embodiments, differences in chrominance components, luminance components, or a combination of chrominance and luminance components may be determined by image processor 156.

Image processor 156 may also determine characteristics of images. For example, image processor 156 may determine the brightest, darkest or most saturated parts of an image. In some embodiments updates to segments are based at least in part on characteristics of corresponding portions of the image. For example, other factors being equal a segment for which an extreme of brightness (e.g. maximum brightness) has changed most may be scheduled ahead of a segment for which the extreme of brightness has experienced a smaller change since the segment was last updated.

Update scheduler 157 schedules updates to segments of a SLM (not shown) and a light source (not shown). Update scheduler 157 may determine an selection (subset) of segments to be updated for a frame, an order for updating segments in a frame, a schedule of times within a frame period at which segments are updated, a combination thereof, or the like. Update scheduler 157 may base update scheduling, at least in part, on image characteristics and image differences determined by image processor 156. Update scheduler 157 may maintain a history of image characteristics and image differences. Update scheduler 157 may also maintain an update history for segments of the SLM (not shown) and the light source (not shown). Update scheduler 157 may base update scheduling, at least in part, on the update histories of segments.

Update scheduler 157 provides update scheduling information to light source controller 152 and light modulator controller 155. Light source controller 152 generates illumination control signals 158 based at least in part on the update scheduling information provided by update scheduler 157. Light modulator controller 155 generates light modulation control signals 159 based at least in part on the update scheduling information provided by update scheduler 157.

The illustrated embodiment comprises light field simulator 154 and correspondence manager 153. Image processor 156 and update scheduler 157 may appear in embodiments that do not comprise light field simulator 154 or correspondence manager 153. In some embodiments, image processor 156 and update scheduler 157 may be combined into a component.

From the foregoing, it can be appreciated that some embodiments may provide improved image quality by coordinating blanking of segments of a backlight with updating of corresponding segments of a SLM. Further, the segments may be updated in an order that is not fixed or an order that does not progress in the same sequence as a raster scan or an order that does not correspond to the physical arrangement of the elements of the segments. Also, it is not mandatory that different segments be updated in sequence. In some embodiments, updating of different segments may be done in parallel or done in time periods that overlap.

Certain implementations of the invention comprise computer processors which execute software instructions which cause the processors to perform a method of the invention.

For example, one or more processors in an light source controller may implement methods as described herein by executing software instructions from a program memory accessible to the processors. The invention may also be provided in the form of a program product. The program product may comprise any medium which carries a set of computer-readable signals comprising instructions which, when executed by a data processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, flash RAM, or the like. The computer-readable signals on the program product may optionally be compressed or encrypted.

In certain implementations of the invention logic to perform methods as described herein is embodied in logic circuits. The logic circuits may comprise hard-wired circuits and/or configurable circuits such as field programmable gate arrays FPGAS.

Where a component (e.g. a software module, controller, processor, assembly, buffer, register, driver, device, circuit, logic, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The invention claimed is:

1. A display for displaying a sequence of frames of image data, the display comprising:

a light source comprising a plurality of light source segments placed across a backplane area, each light source segment comprising a plurality of individually-controllable light emitters, wherein the set of light source segments partition said backplane area into a set of substantially non-overlapping spatial segments;

a spatial light modulator comprising a plurality of SLM segments, each SLM segment comprising a plurality of individually-controllable elements and corresponding to one or more light source segments containing one or more light emitters physically arranged to contribute to illumination of at least one of the plurality of individually-controllable elements of the SLM segment; and a controller configured to update, for a first frame, the SLM segments according to a first order and, for a second frame, to update the SLM segments according to a second order;

wherein the first order is different from the second order, and each SLM segment update is derived with consideration of light characteristics of its corresponding light source segment(s) that vary from one light source segment to another in a same frame.

2. A display according to claim 1 wherein the controller is configured to blank one or more light source segments to which an SLM segment corresponds while updating the SLM segment.

3. A display according to claim 1 wherein the controller is configured to update one or more light source segments to which an SLM segment corresponds while updating the SLM segment.

4. A display according to claim 1 wherein the controller is configured to determine the order for updating the SLM segments based at least in part on the image data.

5. A display according to claim 1 wherein the controller is configured to update a subset of the SLM segments corresponding to parts of a frame that differ more from a previous frame than other parts of the frame.

6. A display according to claim 1 wherein the controller is configured to update a subset of the SLM segments that have not been updated for at least a threshold number of frames.

7. A display according to claim 1 wherein the controller is configured to compute desired driving values for the light source segments from image data for a current frame and to update a subset of the light source segments for which the desired driving values differ most from current driving values for the light source segments.

8. A display according to claim 1 wherein the controller is configured to update a subset of the light source segments that have not been updated for at least a threshold number of frames.

9. A display according to claim 1 wherein the controller is configured to update a fraction 1/n of the SLM segments for each frame of the sequence of frames, where n is an integer in the range of 2 to 10.

10. A display according to claim 1 wherein the controller is configured to update the SLM segments in a rolling pattern.

11. A display according to claim 1 wherein the controller is configured to update the SLM segments in a cascading pattern.

12. A display according to claim 1 comprising a light field simulator configured to estimate the light provided by the illumination source to the SLM segments for a given set of driving values, wherein:

the controller is configured to apply the estimates generated by the light field simulator in updating the SLM segments;

the controller is configured to determine to the light field simulator light source segments that will be updated for a frame; and the controller is configured to re-use existing light field estimates for SLM segments that correspond to light source segments not being updated for the frame.

13. A display according to claim 1 comprising a correspondence manager configured to maintain configurable correspondence relationships, each correspondence relationship associating an SLM segment and one or more light source segments containing one or more light emitters physically arranged to contribute to illumination of at least one of the plurality of individually-controllable elements of the SLM segment.

14. A display according to claim 1 wherein the individually-controllable elements of the SLM are physically arranged in rows and at least two of the SLM segments comprise different sets of individually-controllable elements from a single one of the rows.

15. A display according to claim 1 wherein the SLM segments are physically arranged in a sequence.

16. A display according to claim 15 wherein the sequence in which the SLM segments are arranged begins with a SLM segment including a top left corner of the display and ends with a SLM segment including a bottom right corner of the display.

17. A method for controlling a display to display a sequence of frames, the display comprising:

a light source comprising a plurality of light source segments placed across a backplane area, each light source segment comprising a plurality of individually-controllable light emitters, wherein the set of light source segments partition said backplane area into a set of substantially non-overlapping spatial segments;

a spatial light modulator comprising a plurality of SLM segments, each SLM segment comprising a plurality of individually-controllable elements and corresponding to one or more light source segments containing one or more light emitters physically arranged to contribute to illumination of at least one of the plurality of individually-controllable elements of the SLM segment;

the method comprising:

for a first frame, updating the SLM segments according to a first order; and for a second frame, updating the SLM segments according to a second order;

wherein the first order is different from the second order and each SLM segment update is derived with consideration of light characteristics of its corresponding light source segment(s) that vary from one light source segment to another.

18. A method according to claim 17 comprising blanking one or more light source segments to which an SLM segment corresponds while updating the SLM segment.

19. A method according to claim 17 comprising updating one or more light source segments to which an SLM segment corresponds while updating the SLM segment.

20. A method according to claim 17 comprising, for a third frame, updating a subset of the SLM segments.

21. A method according to claim 20 wherein the subset of SLM segments corresponds to parts of the third frame that differ more as between the third frame and a previous frame than other parts of the third frame.

22. A method according to claim 20 wherein the subset of SLM segments comprises SLM segments that have not been updated for at least a threshold number of frames.

23. A method according to claim 17 comprising for the first frame updating a subset of the light source segments for which the desired driving values differ most from current driving values for the light source segments.

24. A method according to claim 17 comprising for the first frame updating a subset of the light source segments that have not been updated for at least a threshold number of frames.

* * * * *